US012745844B1

(12) United States Patent
Yang

(10) Patent No.: US 12,745,844 B1
(45) Date of Patent: Sep. 29, 2026

(54) HANGING SEAT WITH ADJUSTABLE SEAT SURFACE HEIGHT

(71) Applicant: Zhejiang Hengfeng Top Leisure Co., Ltd., Zhejiang (CN)

(72) Inventor: Baoqing Yang, HangZhou (CN)

(73) Assignee: Zhejiang Hengfeng Top Leisure Co., Ltd., Zhejiang (CN)

( * ) Notice: Subject to any disclaimer, the term of this patent is extended or adjusted under 35 U.S.C. 154(b) by 286 days.

(21) Appl. No.: 18/834,133

(22) PCT Filed: Oct. 26, 2022

(86) PCT No.: PCT/CN2022/127623

§ 371 (c)(1),
(2) Date: Dec. 13, 2024

(87) PCT Pub. No.: WO2023/098350

PCT Pub. Date: Jun. 8, 2023

(30) Foreign Application Priority Data

Nov. 30, 2021 (CN) ..... 202122990121.3

(51) Int. Cl.
*A47C 3/32* (2006.01)
*A47C 7/22* (2006.01)
*A47C 7/62* (2006.01)

(52) U.S. Cl.
CPC ..... *A47C 3/32* (2013.01); *A47C 7/22* (2013.01); *A47C 7/624* (2018.08)

(58) Field of Classification Search
CPC ..... A47C 3/32; A47C 7/624; A47C 7/22
USPC ..... 297/344.12, 55, 4
See application file for complete search history.

(56) References Cited

U.S. PATENT DOCUMENTS 226,252 A * 4/1880 Smith et al. ..... A47C 9/10 297/4
1,876,479 A * 9/1932 Weller ..... A47C 4/40 297/440.11
2,656,875 A * 10/1953 Hutchinson ..... A47C 9/04 224/267
3,895,839 A * 7/1975 Amato ..... A47C 3/32 297/26
4,762,256 A * 8/1988 Whitaker ..... B62B 7/08 280/30
5,620,227 A * 4/1997 Brune ..... A47C 4/52 297/DIG. 6
5,673,966 A * 10/1997 Morton, Jr. ..... A47C 9/10 297/195.11

(Continued)

FOREIGN PATENT DOCUMENTS

CN 209403920 U * 9/2019
CN 214072230 U * 8/2021

*Primary Examiner* — Jose V Chen
(74) *Attorney, Agent, or Firm* — Thompson Coburn LLP

(57) ABSTRACT

A hanging seat has an adjustable seat surface height, and includes a seat surface component and a supporting component. A first belt body has one end connected with the seat surface component and a free opposite end that is movable to change the connection length of the first belt body and the seat surface assembly. A first connection assembly has first and second buckle bodies. The first buckle body is movably connected to the first belt body, and the second buckle body is configured to position the free end of the first belt body. A second connection assembly is connected to the support assembly and the first belt body.

10 Claims, 5 Drawing Sheets

(56) References Cited

U.S. PATENT DOCUMENTS

| | | | | |
|---|---|---|---|---|
| 5,839,783 | A * | 11/1998 | Black | A01M 31/02 297/380 |
| 7,073,852 | B1 * | 7/2006 | Zheng | A47C 4/286 297/16.2 |
| 7,644,981 | B2 * | 1/2010 | Hensley | A47C 4/52 297/53 |
| 8,303,032 | B1 * | 11/2012 | Platta | A47C 4/52 297/183.5 |
| 2010/0133303 | A1 * | 6/2010 | Schilly | A45F 3/047 224/155 |
| 2011/0006564 | A1 * | 1/2011 | Lougee | A47C 4/286 297/55 |
| 2016/0051054 | A1 * | 2/2016 | Choi | A47C 4/286 297/4 |
| 2022/0202172 | A1 * | 6/2022 | Chen | A45F 3/22 |

* cited by examiner

HANGING SEAT WITH ADJUSTABLE SEAT SURFACE HEIGHT

RELATED APPLICATION DATA

The following application in a national stage entry of WO 2023/098350 (PCT/CN2022/127623) having an international filing date of Oct. 26, 2022, which claims priority benefit to Chinese patent application serial no. CN 202122990121.3, filed on Nov. 30, 2021, the disclosures of which are incorporated by reference herein.

FIELD OF THE INVENTION

The invention relates to the technical field of furniture, in particular to a hanging seat with adjustable seat surface height.

BACKGROUND OF THE INVENTION

With the enrichment of material life, the improvement of family income level and the increasing pressure of life and work, people are increasingly looking forward to a leisure and comfortable home life. Leisure hanging seats have gradually replaced traditional hanging seats and become popular in modern cities.

Most of the hanging seats on the market are fixed connection structures, and the height cannot be independently adjusted according to the actual situation. It is very unfriendly to consumers in different markets, and has low flexibility and practicality. Therefore, according to this situation, it is necessary to design a hanging seat with adjustable seat height.

SUMMARY OF THE INVENTION

The invention aims to overcome the shortcomings of the prior art and provide a hanging seat with adjustable seat surface height.

The invention solves the technical problem by adopting the following technical scheme:

The invention relates to a hanging seat with adjustable seat surface height, comprising a seat surface assembly and a support assembly, and further comprising:

A first belt body, one end of which is connected to the seat surface assembly and the other end of which is a free end;

A first connection assembly connecting the seat surface assembly and a first belt body, a free end of the first belt body being movable to change a connection length of the first belt body to the seat surface assembly, the first connection assembly comprising a first buckle body movably connected to the first belt body, and a second buckle body configured to position the free end of the first belt body, the first buckle body being movably connected to the first belt body, the second buckle body being configured to position the free end of the first belt body;

A second connection assembly connected to the support assembly and connected to the first belt body, wherein the second connection assembly connects to the support assembly and connects to the first belt body, the second connection assembly connects to the support assembly.

By connecting the first belt body between the seat surface assembly and the support assembly, the conventional rigid connecting piece on the market for the belt body makes the user have flexibility and buffering feeling when leaning on the seat, and increases the user experience. One end of the first belt body is fixedly connected to the seat surface assembly, the other end is movably connected to the seat surface assembly to change the connection length between the first belt body and the seat surface assembly, and then the first belt body is fixed by the second connection assembly, so that the height of the seat surface assembly can be easily adjusted. This method is simple to operate and can meet the needs of people of different ages and intelligence levels. By quickly adjusting the height of the seat surface, it can meet the needs of people of different heights; On the other hand, the second connection assembly is connected with the first belt body, so that the two connecting ends of the first belt body and the seat surface assembly and the connecting ends of the second connection assembly are in a triangular state. The bearing capacity of the first belt body is more reasonable, thereby ensuring the service life of the first belt body.

Preferably, the second connection assembly includes a base connected with the support assembly, the base is rotatably connected with a first buckle body and a second buckle body, the second buckle body buckles the first buckle body, a gap is left between the first buckle body, the second buckle body and the base, the first buckle body is formed with outer convex tooth facing the side of the base, and the base is formed with tooth groove adapted to the outer convex tooth, and the first belt body is fixed by the outer convex tooth of the first buckle body and the tooth groove of the base, and the second buckle body is fixed by the second buckle body, so that the overall fixing effect is better, and the stability of the hanging seat is guaranteed.

Preferably, the first connection assembly includes a first buckle body and a second buckle body, the second buckle body is formed with a notch, the second buckle body includes a cross beam to divide the notch into two, the second buckle body is slidably connected with the first belt body, the first buckle body is connected with the seat surface assembly, the first buckle body is formed with a notch, the free end of the first belt body passes through the first buckle body and is movably connected with it, and the free end of the first belt body passes through the first buckle body and is connected with the cross beam of the second buckle body.

Preferably, the seat surface assembly includes a seat rest surface, one end of the seat rest surface is connected to the first connection assembly, and the other end is connected to the first belt body with a second belt body.

Preferably, one end of the second belt body is connected to the first belt body, the other end is a free end, the seat surface is connected to a third buckle body, the free end of the second belt body cooperates with the third buckle body to have an adjustment state and a locking state, when in the adjustment state, the free end of the second belt body can freely move to change the connection length between one end of the second belt body and the third buckle body, and when in the locking state, the third buckle body locks the second belt body to achieve a fixing effect.

Preferably, the seat surface has an arc shape, and the opposite side edges of the seat surface are formed with extend surface.

Preferably, it further includes a storage assembly, the storage assembly includes a clamping block, a block and a storage box, one end of the clamping block away from the base is formed with a protrusion, a slide groove is formed between the protrusion and the base, the block is connected to the storage box and snapped with the clamping block, the block is formed with a notch adapted to the clamping block, and the block is formed with a wing plate adapted to the slide groove in the notch.

Preferably, the locking block is formed with a locking groove at the slide groove position, and the wing plate is formed with a locking tooth adapted to the locking groove.

Preferably, the support assembly includes oppositely arranged main shaft, a frame body is connected between the oppositely arranged main shaft, projections of the oppositely arranged main shaft on a horizontal plane or a vertical plane are at an included angle, and the base is installed on the main shaft.

The advantages and positive effects of the present invention are:

1. By connecting the first belt body between the seat surface assembly and the support assembly, the conventional rigid connecting piece on the market for the belt body makes the user have flexibility and buffering feeling when leaning on the seat, and increases the user experience. One end of the first belt body is fixedly connected to the seat surface assembly, the other end is movably connected to the seat surface assembly to change the connection length between the first belt body and the seat surface assembly, and then the first belt body is fixed by the second connection assembly, so that the height of the seat surface assembly can be easily adjusted. This method is simple to operate and can meet the needs of people of different ages and intelligence levels. By quickly adjusting the height of the seat surface, it can meet the needs of people of different heights; On the other hand, the second connection assembly is connected with the first belt body, so that the two connecting ends of the first belt body and the seat surface assembly and the connecting ends of the second connection assembly are in a triangular state. The bearing capacity of the first belt body is more reasonable, thereby ensuring the service life of the first belt body.

2. In the invention, the outer convex tooth of the first buckle body are matched with the tooth groove of the base to clamp and fix the first belt body, and the first buckle body is further fixed by the second buckle body, so that the overall fixing effect is better, and the stability of the hanging seat is ensured.

Figure 1:
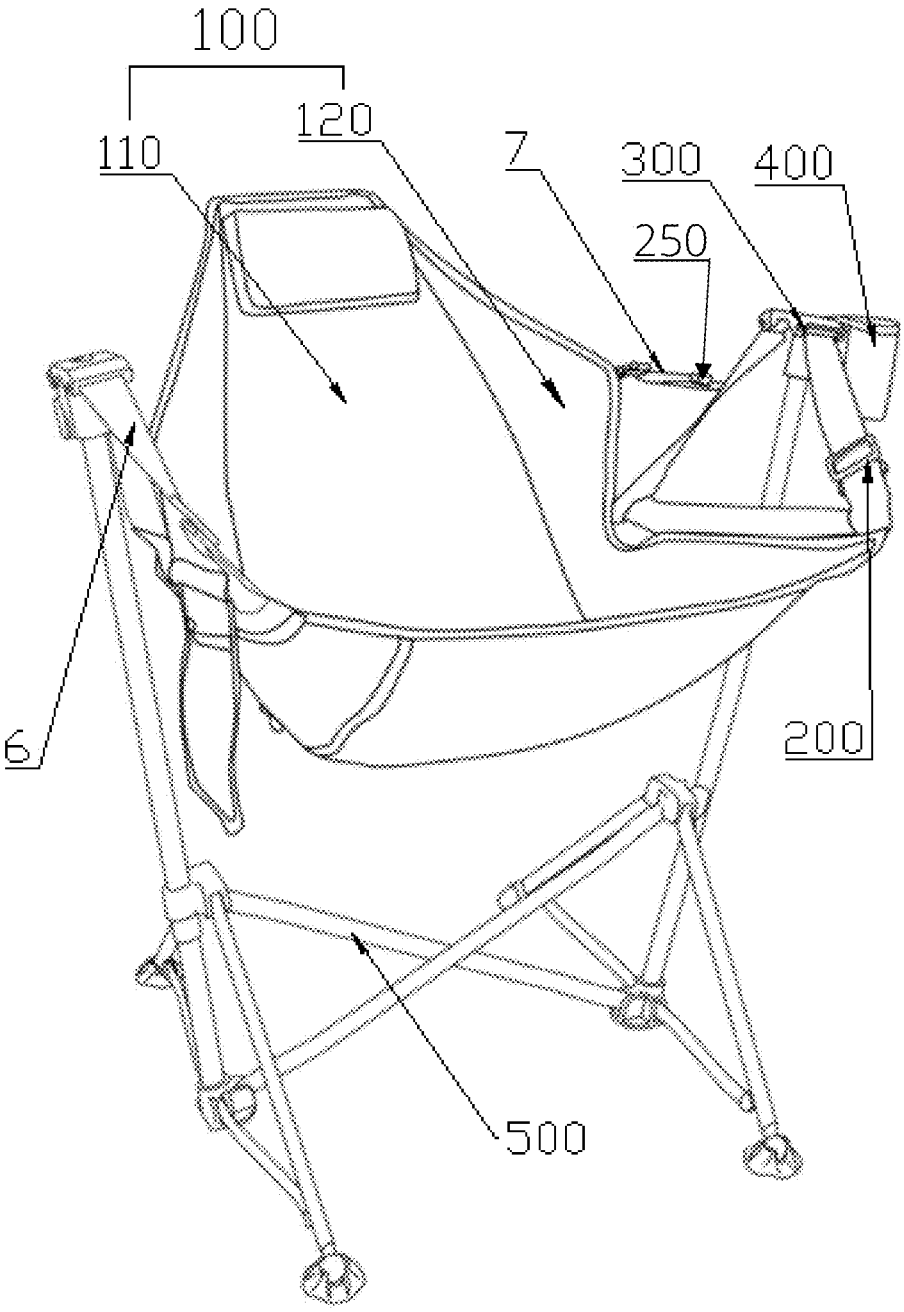
FIG. 1 is a schematic diagram of an axonometric structure according to the present invention.

In the figure: 100, seat surface assembly; 110 seat surface 120 extend surface 200 first connection assembly 210 first buckle body 220 second buckle body 221 cross beam 300 second connection assembly; 310 base 311 tooth groove 320 first pull button 321 outer convex tooth 330 second pull button 400 storage assembly 410 clamping block 411 slide groove 420 block 421 wing plate 422 clamp tooth 430 storage box 500 support assembly 510 main shaft 520 frame body 6 A first belt body 7 A second belt body.

DETAILED DESCRIPTION OF THE INVENTION

Hereinafter, the technical solutions in the embodiments of the present invention will be clearly and completely described with reference to the accompanying drawings in the embodiments of the present invention, and it is obvious that the described embodiments are only a part of the embodiments of the present invention, but not all the embodiments. Based on the embodiments in the present invention, all other embodiments obtained by those skilled in the art without creative work fall within the scope of protection of the present invention.

It should be noted that when a component is referred to as "fixed" to another component, it may be directly on the other component or a centered component may also be present. When one component is considered to be "connected" to another component, it can be directly connected to the other component or there may be a centering component. When one component is considered to be "disposed on" another component, it may be disposed directly on the other component or a centering component may be present at the same time. As used herein, the terms "vertical," "horizontal," "left," "right," and similar expressions are for illustrative purposes only.

Unless otherwise defined, all technical and scientific terms used herein have the same meaning as commonly understood by those skilled in the art belonging to the present invention. The terminology used herein in the specification of the invention is for the purpose of describing specific embodiments only, and is not intended to limit the invention. The term "and/or" as used herein includes any and all combinations of one or more related listed items.

Embodiments of the present invention will be described in further detail with reference to the accompanying drawings:

The invention relates to a hanging seat with adjustable seat surface height, comprising a seat surface assembly 100 and a support assembly 500, and further comprising:

- A first belt body 6, one end of which is connected to the seat surface assembly 100 and the other end of which is a free end;
- A first connection assembly 200 connecting the seat surface assembly 100 and the first belt body 6, the free end of the first belt body 6 being movable to change the connection length of the first belt body 6 and the seat surface assembly 100, the first connection assembly 200 comprising a first buckle body 210 movably connected to the first belt body 6, and a second buckle body 220 configured to position the free end of the first belt body 6;
- A second connection assembly 300 connects the support assembly 500 and is connected to the first belt body 6.

Figure 7:
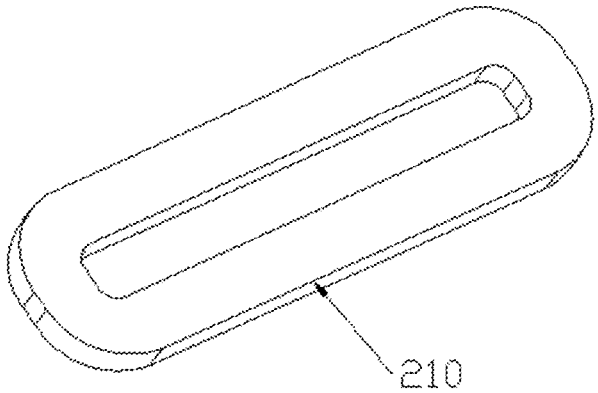
FIG. 7 is a schematic diagram of the axonometric structure of the first buckle body according to the present invention.
Figure 8:
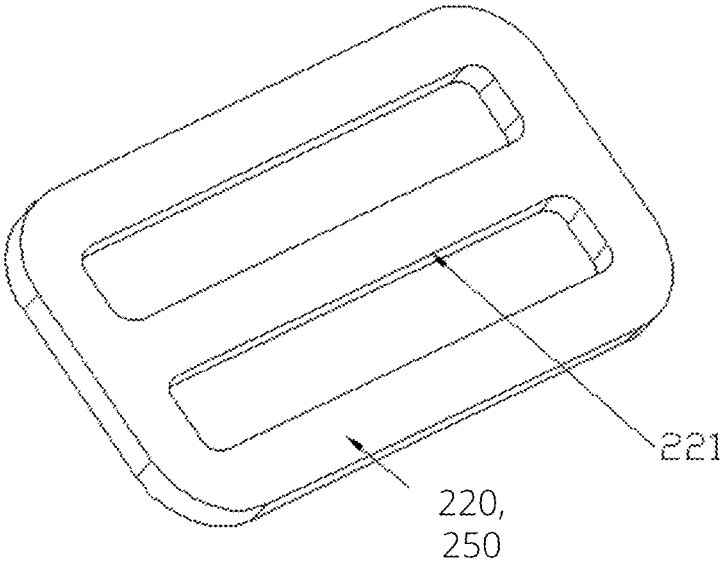
FIG. 8 is a schematic diagram of the axonometric structure of the second buckle body and the third buckle body according to the present invention, the second and third buckle body having the same structure.

Specifically, as shown in FIG. 1, there are two supporting points on the left and right sides above the support assembly 500, and there are two second connection assembly 300, which are respectively installed on the supporting points on two sides of the support assembly 500. The first belt body 6 passes through the inside of the second connection assembly 300, and the second connection assembly 300 is capable of fixing and relaxing the first belt body 6. In the relaxed state, the belt bodies can freely move in the second connection assembly 300, and there are two first belt body 6 corresponding to the support assembly 500, which are respectively installed on the left and right sides of the seat surface assembly 100. One end of the first belt body 6 is fixedly mounted on the rear side of the seat surface assembly 100, and the other end is a free end and can freely move. The first connection assembly 200 includes a first buckle body 210 and a second buckle body 220. As shown in FIG. 8, the second buckle body 220 has a RI shape, and a notch is formed in the second buckle body 220. The second buckle body 220 includes a cross beam 221 to divide the notch into two, and the second buckle body 220 is slidably connected with the first belt body 6. The free end of the first belt body 6 is bent through the notch on the left side of the second buckle body 220, and then penetrates through the notch on the right side. As shown in FIG. 7, the first buckle body 210 is fixedly connected to the chair surface assembly 100, a notch is formed in the first buckle body 210, and the entire first buckle body 210 has a mouth-like shape. The free end of the first belt body 6 passes through the first buckle body 210 and is movably connected with the first buckle body 210 after passing through the second connection assembly 300, and the free end of the first belt body 6 passes through the first buckle body 210 and is connected with the cross beam 221 of the second buckle body 220. In other words, the free end of the first belt body 6 is connected to the cross beam 221 of the second buckle body 220 again after being bent through the notch of the first buckle body 210 after the second buckle body 220 is connected to the second buckle body 220. The connection method may be penetrated through the right notch of the second buckle body 220, penetrated through the left notch, and then tied a knot at the free end to achieve fixation. This method is beneficial to increasing the friction force between the cross beam 221 and the first belt body 6, and increasing the fixing effect thereof. In other embodiments, it is also possible to secure the free end directly to the cross beam 221. It should be noted that the free end of the first belt body 6 cannot affect the movement of the second buckle body 220 on the first belt body 6. By stretching the free end of the first belt body 6, the second buckle body 220 cooperates with the free end of the first belt body 6 to move backward, and the length between the fixed end of the first belt body 6 and the first buckle body 210 is reduced. On the contrary, the length between the fixed end of the first band body 6 and the first buckle body 210 is increased.

In other embodiments, the seat surface assembly 100 is connected with a third belt body, one end of the third belt body is fixed on the seat surface assembly 100, and the other end of the third belt body is folded back and fixed on the seat surface assembly 100 after passing through the notch of the first buckle body 210, so that the flexibility of the seat surface assembly 100 is higher, and the position of the second buckle body 220 is easier to adjust.

By connecting the first belt body 6 between the seat surface assembly 100 and the support assembly 500, the conventional rigid connecting member of the belt body on the market makes the user have flexibility and cushioning when leaning on the seat, and increases the user experience. One end of the first belt body 6 is fixedly connected to the chair surface assembly 100, the other end is movably connected to the chair surface assembly 100 to change the connection length between the first belt body 6 and the chair surface assembly 100, and then the first belt body 6 is fixed by the second connection assembly 300, so that the height of the chair surface assembly 100 can be easily adjusted. This method is simple to operate and can meet the needs of people with different age levels and intelligence levels, and can meet the needs of people with different heights by quickly adjusting the height of the seat surface. On the other hand, the second connection assembly 300 is connected to the first belt body 6, so that the two connecting ends of the first belt body 6 and the chair surface assembly 100 and the connecting ends of the second connection assembly 300 are in a triangular state. The bearing capacity of the first belt body 6 is more reasonable, and the service life of the first belt body 6 is guaranteed.

Figure 3:
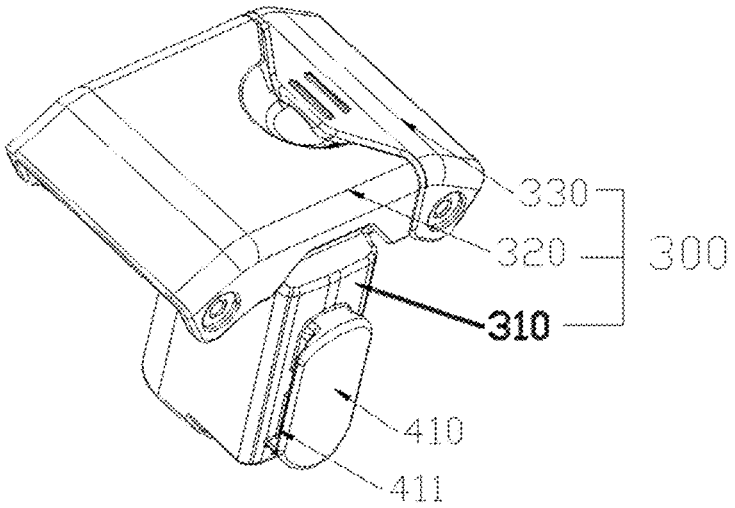
FIG. 3 is an axonometric schematic diagram of the second connection assembly according to the present invention.
Figure 4:
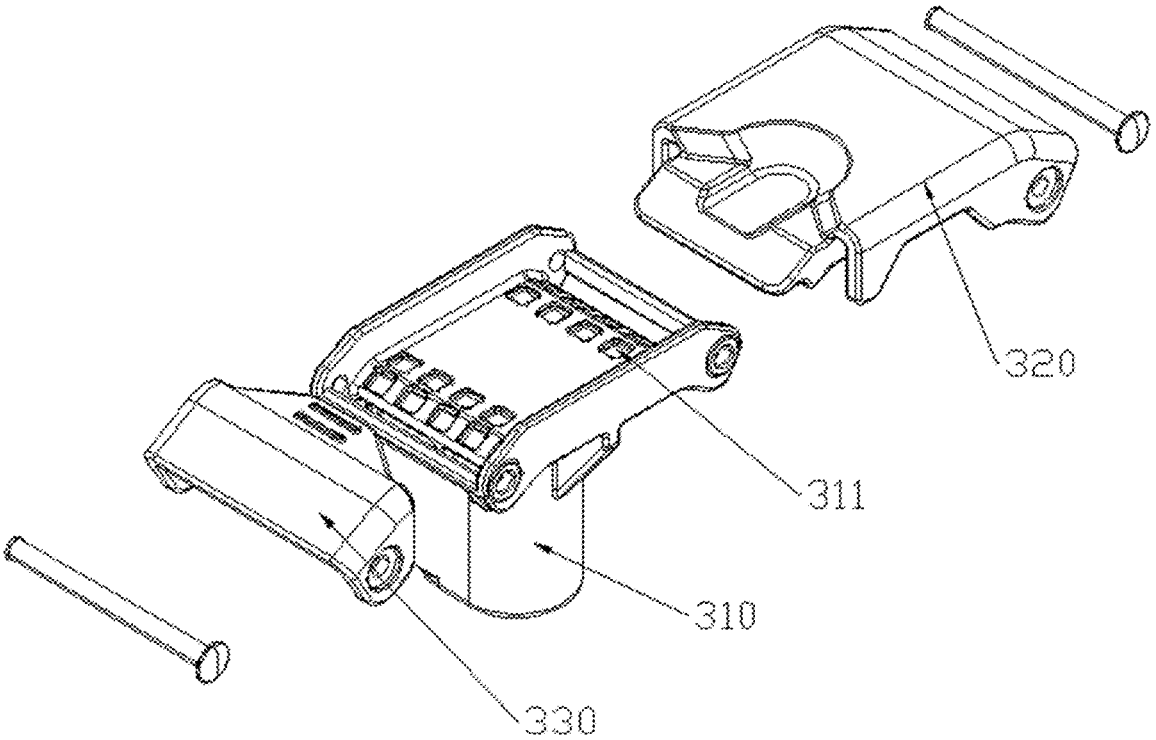
FIG. 4 is an exploded view of a second connection assembly according to the present invention.
Figure 5:
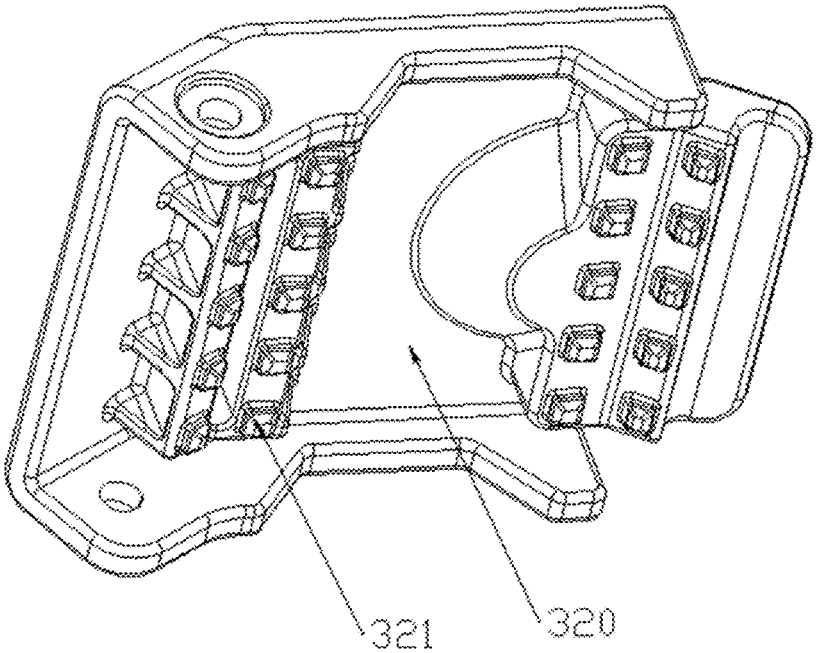
FIG. 5 is a schematic diagram of the axonometric structure of the first buckle body according to the present invention.

Further, in another embodiment, the second connection assembly 300 includes a base 310 connected to the support assembly 500, the base 310 being rotatably connected with a first pull button 320 and a second pull button 330, and the second pull button 330 engages the first pull button 320. A gap is left between the first pull button 320, the second pull button 330, and the base 310. The first pull button 320 is formed with outer convex tooth 321 facing the base 310 side. The base 310 is formed with a tooth groove 311 adapted to the outer convex tooth 321. The outer convex tooth 321 of the first pull button 320 are matched with the tooth groove 311 of the base 310 to clamp and fix the first belt body 6, and the first pull button 320 is further fixed by the second pull button 330, so that the overall fixing effect is better and the stability of the hanging seat is guaranteed. Specifically, as shown in FIGS. 3 and 4, the left and right sides of the base 310 are rotatably connected with a rotating shaft. Taking the perspective of FIG. 4 as an example, the right rotating shaft is connected to the first buckle plate so that the first buckle plate is rotatably connected with the base 310, and the left rotating shaft is connected to the second buckle plate so that the second buckle plate is rotatably connected with the base 310. The left side of the first buckle body 210 is formed with a buckle groove, and the lower side of the second buckle body 220 is formed with buckle tooth (not shown in the figure) adapted to the buckle groove. The upper surface of the base 310 is a flat surface, and the left and right ends of the flat surface are bent and extend downward, so that the entire structure is high in the middle and low in both ends. A certain distance is left between the rotating shaft and the upper surface of the base 310 so as to facilitate the first belt body 6 to pass through, and the fixing effect on the first belt body 6 is increased after the first buckle body 210 is fastened. A tooth groove 311 is formed on the upper surface of the base 310. Preferably, one row of tooth groove 311 is formed at both left and right ends of the upper surface plane, and one row of tooth groove 311 is formed at each downward bent folded surface. Specifically, one row of four tooth groove 311 is formed on the left and right ends of the upper surface plane, and one row of four tooth groove 311 is formed on the folded surface. Correspondingly, as shown in FIG. 5, the outer convex tooth 321 are formed on the lower side of the first buckle body 210, and the positions and numbers of the outer convex tooth 321 correspond to the tooth groove 311, thereby realizing snap engagement.

In another embodiment, the seat surface assembly 100 includes a seat rest surface 110, the seat rest surface 110 is arc-shaped, the opposite side edges of the seat rest surface 110 are formed with an extend surface 120, one end of the seat rest surface 110 is connected to the first connection assembly 200, and the second belt body 7 is connected between the other end and the first belt body 6.

Specifically, as shown in FIG. 1, the seat rest surface 110 includes a seat surface and a rest surface, and the two are connected to form an arc shape as a whole. In other embodiments, it may also be in a folded angle shape, mainly to facilitate adjustment of the angle between the rest surface and the seat surface. The left and right sides of the seat rest surface 110 are respectively provided with an extend surface 120 to increase the shielding effect of both sides of the seat rest surface 110, and can play a certain surrounding effect to improve the seat rest experience. The fixed end of the first belt body 6 is approximately connected to the side of the abutment surface close to the seat surface, the first buckle body 210 is connected to the front side of the seat surface, and the second belt body 7 is installed between the extend surface 120 and the first belt body 6 to increase the support of the abutment surface and make the overall structure more stable In another embodiment, one end of the second belt body 7 is connected to the first belt body 6, the other end is a free end, the seat surface 110 is connected to the third buckle body 250, and the free end of the second belt body 7 matches the third buckle body 250 to have an adjustment state and a locking state. When in the adjustment state, the free end of the second belt body 7 can freely move to change the connection length between one end of the second belt body 7 and the third buckle body 250. When in the locking state, the third buckle body 250 locks the second belt body 7 to achieve a fixing effect. Specifically, as shown in FIG. 1 and FIG. 8, the third buckle body 250 and the second buckle body 220 have the same structure, and on the mounting seat rest surface 110, the free end of the second belt body 7 enters from one notch of the third buckle body 250 and is bent and then enters another notch. The third buckle body 250 and the second belt body 7 have sufficient friction force to realize the fixation of the second belt body 7, and the free end of the second belt body 7 is knotted to prevent the second belt body 7 from being separated from the third buckle body 250 due to slippage. By adjusting the connection length of the second belt body 7 between the third buckle body 250 and the seating surface 110, the seating surface angle can be adjusted, and the function can be diversified.

Figure 6:
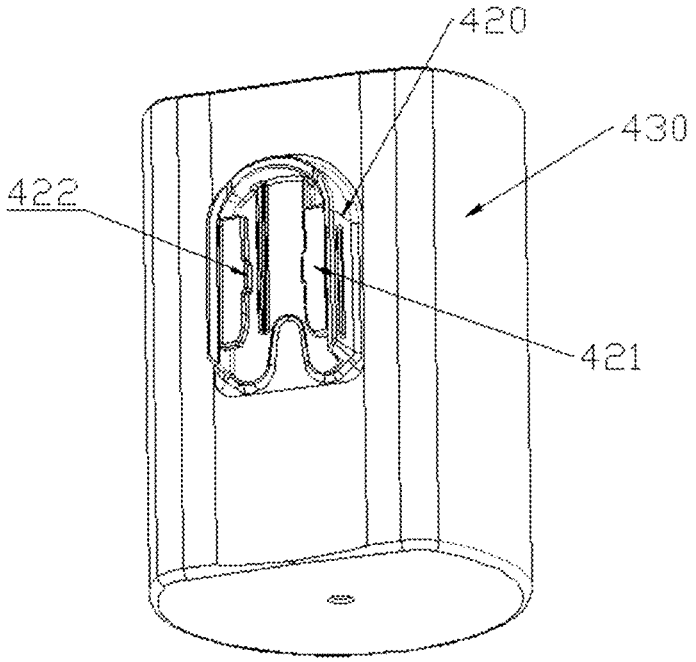
FIG. 6 is a schematic diagram of the axonometric structure of the storage box according to the present invention.

In another embodiment, the storage assembly 400 is further included on the basis of the above embodiment, and the storage assembly 400 includes a clamping block 410, a block 420, and a storage box 430. A protrusion is formed at one end of the clamping block 410 away from the base 310, a slide groove 411 is formed between the protrusion and the base 310, and the block 420 is connected to the storage box 430 and is engaged with the clamping block 410. The block 420 is formed with a notch adapted to the clamping block 410, the block 420 is formed with a wing plate 421 adapted to the slide groove 411 in the notch, the clamping block 410 is formed with a slide groove slot at the position of the slide groove 411, and the wing plate 421 is formed with a slide groove tooth 422 adapted to the slide groove slot. Specifically, as shown in FIG. 3, a clamping block 410 is mounted on the right side of the base 310, the right side of the clamping block 410 extends in the front-rear direction to form a protrusion, and a slide groove 411 is formed between the protrusion and the base 310 so as to cooperate with the card base 420. It should be noted that both the upper and lower sides of the clamping block 410 are arc-shaped, and the protrusion on the lower side of the clamping block 410 is connected to the base 310 to close the slide groove 411 formed by the protrusion and the base 310. As shown in FIG. 6, the storage box 430 has a storage space (the internal storage space is not shown from the viewing angle of FIG. 6), and a block 420 is mounted on one side of the storage box 430, the block 420 has a dovetail groove structure, and a notch is formed in the middle of the block 420. The inner side surface of the notch is matched with the outer side surface of the clamping block 410, and the block 420 is symmetrically formed with a wing plate 421 adapted to the slide groove 411, and the clamping tooth 422 are formed on the wing plates 421. On the other hand, a slide groove 411 of the clamping block 410 is formed with a slide groove for the clamping block 410 to facilitate the clamping block 410.

Figure 2:
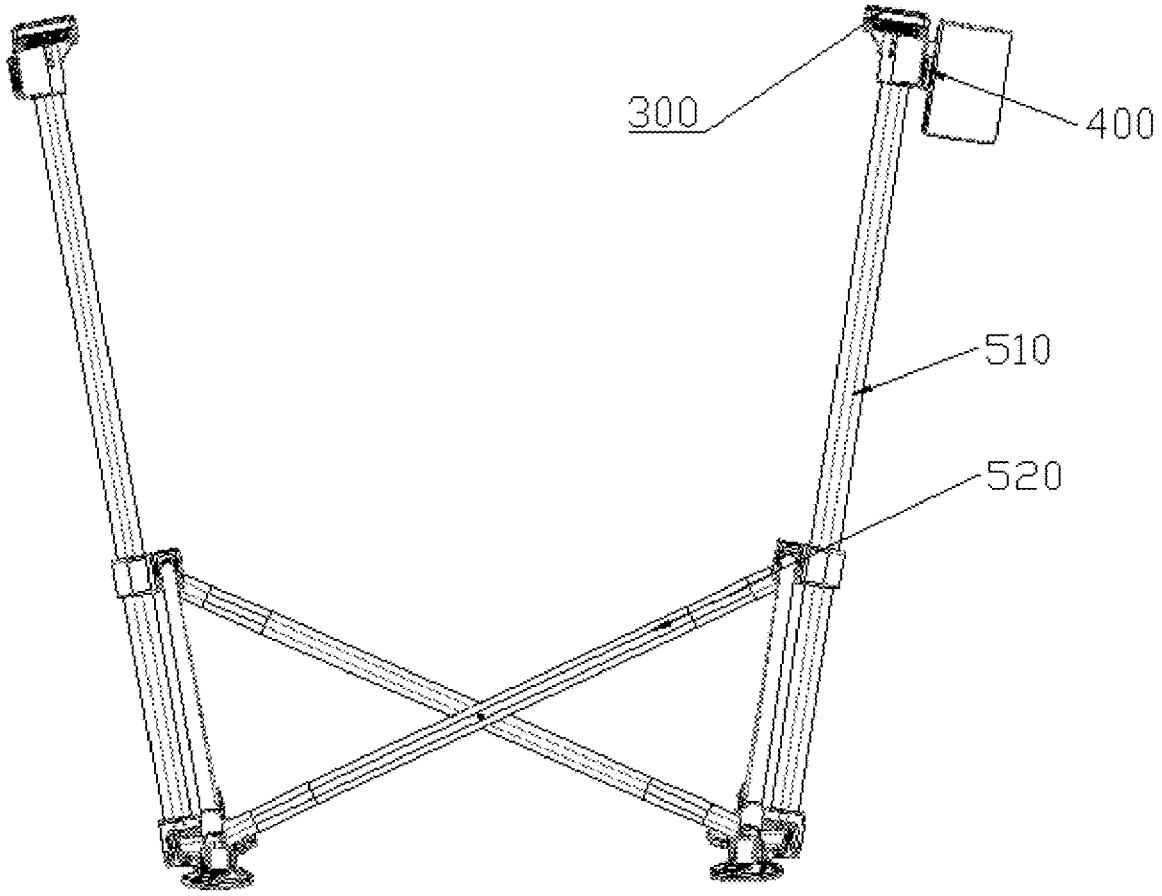
FIG. 2 is a front view of the present invention.

The support assembly 500 includes oppositely arranged main shaft 510, the frame body 520 is connected between the oppositely arranged main shaft 510, the projection of the oppositely arranged main shaft 510 on the horizontal plane or the vertical plane is at an included angle, and the base 310 is installed on the main shaft 510. Specifically, as shown in FIG. 2, the main shaft 510 is symmetrically formed at an angle of 20° from the left to the right, and correspondingly, the lower side of the base 310 is provided with a mounting port, and the mounting port is sleeved on the main shaft 510. It should be emphasized that the embodiments described in the present invention are illustrative and not limiting, and thus the present invention is not limited to the embodiments described in the Detailed Description, and any other embodiment obtained by those skilled in the art according to the technical solutions of the present invention also fall within the scope of protection of the present invention.

The invention claimed is:

1. A hanging seat with an adjustable seat surface height comprises:

a seat surface assembly (100) and a support assembly (500);

a first belt body (6), one end of the first belt body (6) being connected with the seat surface assembly (100) and an opposite end of the first belt body (6) being a free end;

a first connection assembly (200), the first connection assembly (200) being connected to the seat surface assembly (100) and the first belt body (6), wherein the free end of the first belt body (6) is movable to change the connection length of the first belt body (6) with the seat surface assembly (100), the first connection assembly (200) includes a first buckle body (210) and a second buckle body (220), the first buckle body (210) is movably connected to the first belt body (6), and the second buckle body (220) is configured to position the free end of the first belt body (6); and a second connection assembly (300), the second connection assembly (300) being connected to the support assembly (500) and releasably engageable with the first belt body (6);

wherein the second connection assembly (300) includes a base (310) connected to the support assembly (500), the base (310) is rotatably connected with a first pull button (320) and a second pull button (330), the second pull button (330) snaps over the first pull button (320) with a gap between the first pull button (320), the second pull button (330) and the base (310).

2. A hanging seat with adjustable seat surface height according to claim 1 wherein the second buckle body (220) is formed with a notch, the second buckle body (220) comprises a cross beam (221) dividing the notch into two portions, the first buckle body (210) has a notch formed in the first buckle body, one side of the notch of the first buckle body is connected with the seat surface assembly (100), and an opposite side of the notch of the first buckle body (210) is movably connected with the first belt body (6), the first belt body (6) passes around the cross beam (221) of the second buckle body (220) and is slidably connected with the second buckle body (220), the first belt body (6) passes through the notch of the first buckle body (210) and is movably connected with the first buckle body (210), and the free end of the first belt body (6) is connected with the cross beam (221) of the second buckle body (220).

3. A hanging seat with adjustable seat surface height according to claim 1 wherein the seat surface assembly (100) comprises a seat rest surface (110), one end of the seat rest surface (110) is connected to the first connection assembly (200), and a second belt body (7) is connected between another end of the seat rest surface (110) and the first belt body (6).

4. A hanging seat with adjustable seat surface height according to claim 3 wherein one end of the second belt body (7) is connected to the first belt body (6), and the other end is a free end; and the seat surface (110) is connected with a third buckle body, and the free end of the second belt body (7) cooperates with the third buckle body in an adjustment state and a locking state; when in the adjustment state, the free end of the second belt body (7) can be freely moved to change a connection length between one end of the second belt body (7) and the third buckle body; when in the locking state, the third buckle body locks the second belt body (7) to fix the connection length between the one end of the second belt body (7) and the third buckle body.

5. A hanging seat with adjustable seat surface height according to claim 4, wherein the seat surface (110) is curved, and opposite sides of the seat surface (110) are formed with extended surfaces (120).

6. A hanging seat with adjustable seat surface height according to claim 1, further comprising a storage assembly (400), wherein the storage assembly (400) comprises a clamping block (410), a block (420) and a storage box (430), wherein one end of the clamping block (410) away from the base (310) is formed with a protrusion, and a slide groove (411) is formed between the protrusion and the base (310), the block (420) is connected to the storage box (430) and is releasably engageable with the clamping block (410), the block (420) is formed with a notch adapted to releasably engage with the clamping block (410), and the block (420) is formed with a wing plate (421) adapted to cooperate with the slide groove (411) in the notch.

7. A hanging seat with adjustable seat surface height according to claim 6 wherein the clamping block (410) is formed with a clamping slot at the position of the slide groove (411), and the wing plate (421) is formed with a clamp tooth (422) adapted to cooperate with the clamping slot.

8. A hanging seat with adjustable seat surface height according to claim 7 wherein the support assembly (500) includes oppositely arranged main shafts (510), and a frame body (520) is connected between the oppositely arranged main shafts (510) in a manner such that the projection of the respective main shaft (510) on the horizontal plane or the vertical plane is formed at an included angle.

9. A hanging seat with adjustable seat surface height according to claim 8 wherein the base (310) is mounted on the main shaft (510).

10. A hanging seat with adjustable seat surface height according to claim 1 wherein the first pull button (320) is formed with an outer convex tooth (321) on a side facing the base (310), and the base (310) is formed with a tooth groove (311) adapted to receive the outer convex tooth (321).

* * * * *